United States Patent [19]

McMillan

[11] 4,432,529

[45] Feb. 21, 1984

[54] ICE TRAY WITH LID

[76] Inventor: Charles McMillan, 218 E. Franklin St., Quincy, Fla. 32351

[21] Appl. No.: 431,758

[22] Filed: Sep. 30, 1982

[51] Int. Cl.[3] ..... B29C 1/02

[52] U.S. Cl. ..... 249/52; 249/121; 249/126; 249/127; 249/129

[58] Field of Search ..... 249/52, 121, 124, 125, 249/126, 127, 129, 130

[56] References Cited

U.S. PATENT DOCUMENTS

| | | | |
|---|---|---|---|
| 2,587,852 | 3/1952 | Jahn | 249/130 |
| 2,804,755 | 9/1957 | Ansel | 249/121 |
| 3,700,204 | 10/1972 | Swett | 249/104 |
| 4,148,957 | 4/1979 | Gurbin | 249/130 |
| 4,366,941 | 1/1983 | Harris | 249/121 |

*Primary Examiner*—Thomas P. Pavelko

*Attorney, Agent, or Firm*—John B. Dickman, III

[57] ABSTRACT

An ice cube tray having a removable cover for sealing the tray when filled with water. The cover has a fill spout and a cover for the fill spout that cooperate with similar trays for stacking purposes.

1 Claim, 6 Drawing Figures

ICE TRAY WITH LID

This invention relates to an improved ice cube tray and cover of plastic construction, and more particularly, an improved ice cube tray and cover designed to cooperate with similar trays in a stacking relationship.

Covered trays are designed to eliminate spilled water during the filling of the trays and carrying them to the freezer. More often that not water is spilled on the kitchen floor or inside the freezer. It is a purpose of this invention to provide a covered tray which can be filled with the cover on and stacked one on another in the freezer.

Prior to this invention, covered ice cube trays had either full or partial covers and where fill spouts were provided they protruded above the covers which interfered with stacking one tray on another. As such, where the trays were stacked, they were not stable and on occasion fell over with the possibility that the cover would come off spilling the contents. To fill these trays with water, the cover had to be removed and each individual cube compartment had to be filled separately, and the cover replaced. Water would splash out of the tray getting everything nearby wet, and putting a cover on a full tray quite often proved messy and wet.

SUMMARY OF THE INVENTION

The present invention overcomes the undesirable features of conventional covered ice cube trays by replacing the presently used cover with a cover having a fill spout that cooperates with similar trays to form a stable stack. Further the present invention provides an ice cube tray with partitions where each partition has a cut-out connecting the individual ice cube molds so that the entire tray can be filled with the cover on.

The ice cube tray and cover are made of a flexible plastic material, such as polyethylene, polypropylene or one of the other synethetic plastics used in molded containers. It is also contemplated that the tray could be molded from natural rubber or synthetic rubber. While it is important that the tray be made from a flexible material, it is not necessary that the cover be flexible; therefore, it can either be flexible or rigid. Molding the tray from a flexible material permits twisting and flexing the tray to remove the ice cubes without any mechanical device or running cold water over the outer surface of the tray to loosen the cubes.

The compartment partitions may be removable, however it is preferred that the tray and partitions be molded as a single unit.

The objects of this invention will become more apparent from the following specification and claims.

DESCRIPTION OF THE PREFERRED EMBODIMENT

Figure 1:
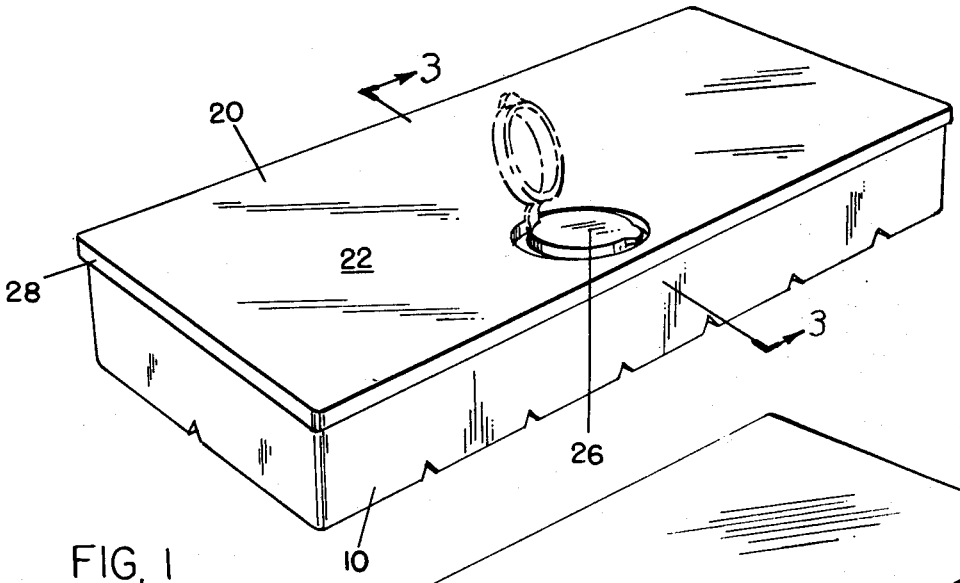
FIG. 1 is a perspective view of an ice cube tray and cover of the present invention.

Referring to FIG. 1 of the drawings, there is illustrated an ice cube tray 10 and a tray cover 20. In the top surface 22 of the tray cover 20 is recessed fill spout 24 and fill spout cover 26, shown best in FIG. 3. The tray cover 20 has a continuous downwardly extending skirt 28 which slips over the top edge of the upstanding side walls 30 and end walls 32 of tray 10.

Figure 3:
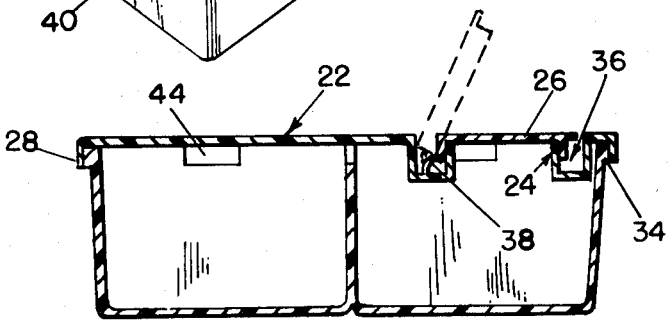
FIG. 3 is a cross sectional view taken along the line 3—3 of FIG. 1 of the ice tray and cover of the present invention.

Running around the top edge of the walls 30 and 32, in FIG. 3, is an outwardly flared bead 34 which engages the inner surface of skirt 28 forming a fluid tight seal. The fill spout 24 is likewise sealed by cover 26 which is tethered in a recess 36 by a strap 38 molded to the bottom of the recess. With cover 26 closed, the tray cover 20 has a continuous flat surface for stacking purposes.

Figure 2:
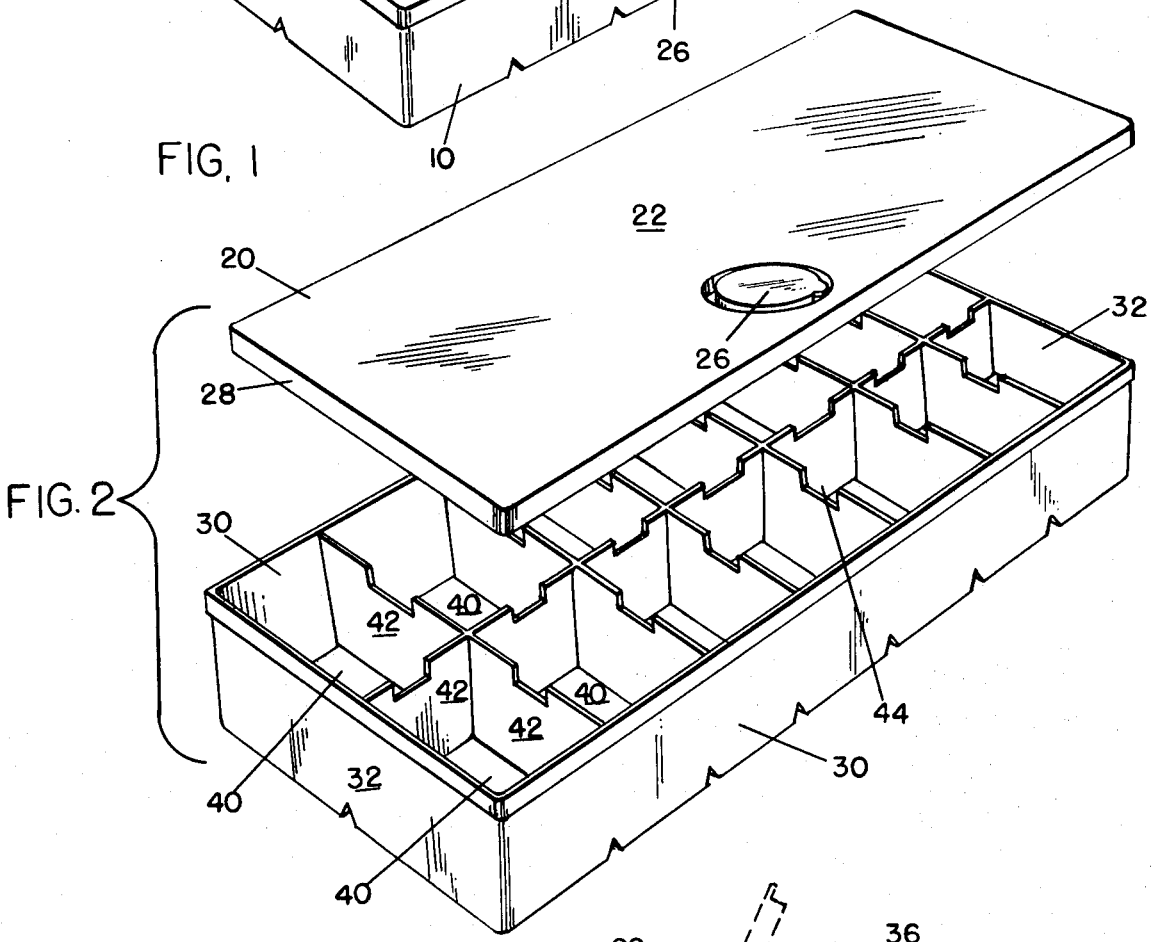
FIG. 2 is a perspective view of an ice cube tray with the cover removed to show the partitions of the present invention.

The tray 10 is divided into compartments 40, as shown in FIG. 2, by partitions 42. It is preferred that the tray and partitions be molded together as a unit, however it is possible to have removable partitions. The partitions 42 have a cut-out 44, see FIG. 3, which connects one compartment to another. The purpose of the cut-out 44 is to allow water to flow into all of the compartments 40 when filling the tray with the cover 20 in place.

Figure 4:
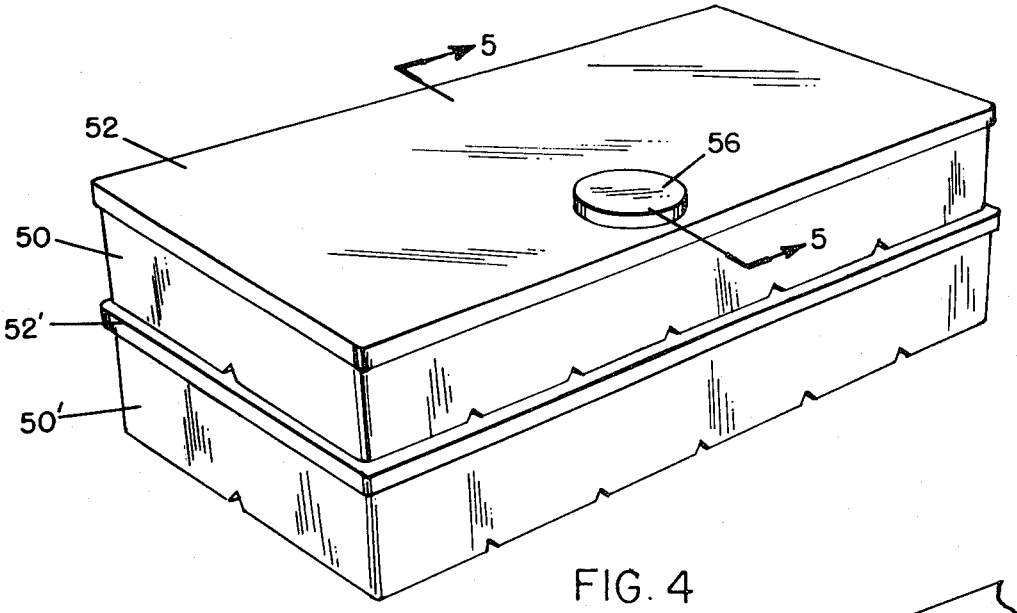
FIG. 4 is a perspective view of two stacked modified ice cube trays and covers of the present invention.
Figure 5:
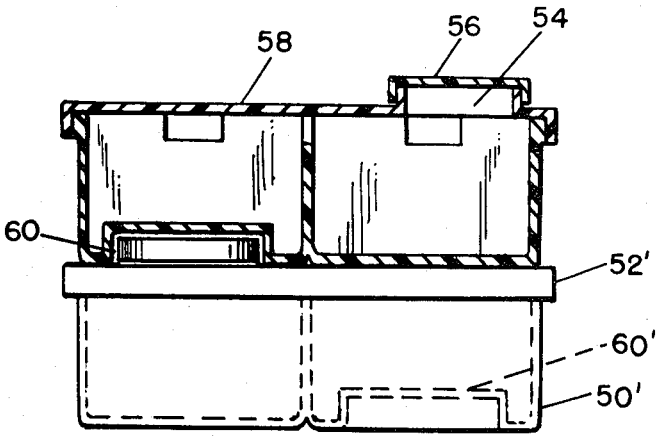
FIG. 5 shows an end view of one of the modified trays and covers of FIG. 4 and a cross sectional view of the other modified tray and cover taken along the line 5—5 of FIG. 4.

The modified tray 50 and tray cover 52 of FIGS. 4 and 5 are shown stacked on a similar tray 50' and tray cover 52'. Cover 52 has a pour spout 54 and cover 56, FIG. 5, which extend above top surface 58 of tray cover 52. The tray 50 has a molded indentation or recess 60 which corresponds to the location of pour spout 54 for cooperatively stacking one covered tray on another. Tray 50' has a similar indentation 60' for receiving the pour spout of another cover tray.

Figure 6:
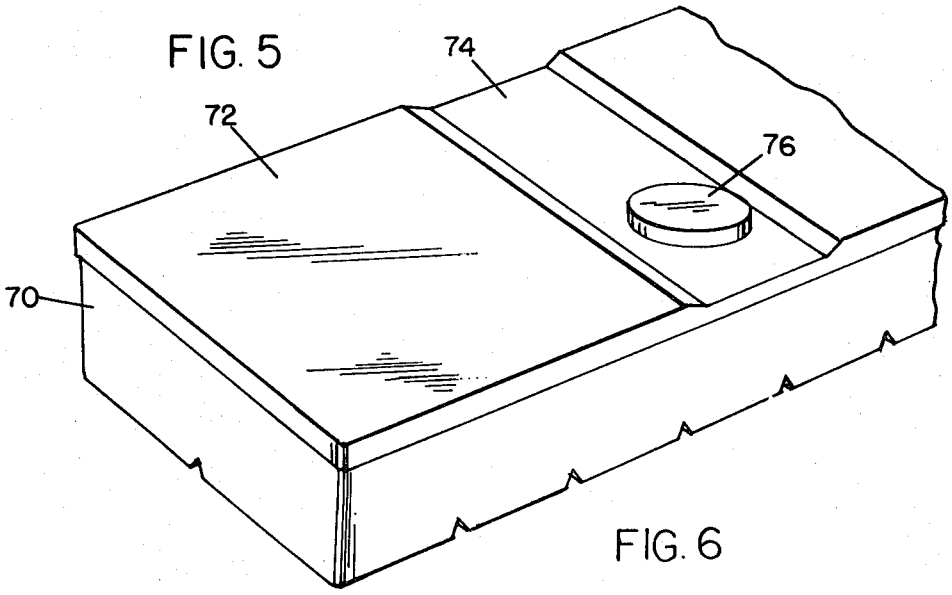
FIG. 6 is a fragmentary perspective view of another modification of the ice cube tray and cover of the present invention.

FIG. 6 shows another modification of the invention where a tray 70 is similar in design to tray 10 of FIG. 10. Tray cover 72, however, has a recessed area 74 running across the width of the cover and a fill spout (not shown) and cover 76 within the recessed area. The height of the fill spout and cover 76 are no greater than the top surface of tray cover 72.

Figure 7:
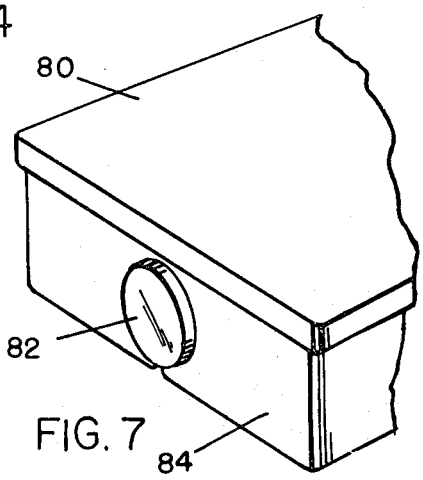
FIG. 7 is a fragmentary perspective view of another modification of the ice cube tray and cover of the present invention.

The modified cover and tray of FIG. 7 included a flat top surface on tray cover 80 and a fill spout (not shown) and cover 82 in one end of tray 84. Since the fill spout is not in the tray cover there is no problem in stacking the covered trays.

It is contemplated that the tray covers of this invention could have an air hole to vent air when filling, however the air hole is not shown.

Even though several embodiments of the invention have been described and illustrated in the accompanying drawings, it will be obvious to those skilled in the art that various modifications may be made without departing from the spirit of this invention. It is therefore intended by the appended claims to cover all modifications which fall within the inventive concept.

I claim:

1. A stackable, covered ice cube tray structure comprising a tray having an outwardly flared bead around its upper peripheral edge and a removable tray cover having a downwardly extending skirt around its lower peripheral edge which secures to said tray by engaging said outwardly flared bead on said tray, ice cube forming compartments in said tray, said tray and said tray cover combination having a recessed filling means in said cover, surrounded on all sides by said tray cover, for filling said covered ice cube tray and a cap on said filling means coplanar with said cover, with fluid when said tray cover is secured to said tray, whereby when said covered trays are stacked, smooth, planar surfaces on said tray covers will allow close engagement of said trays and result in compact, efficient storage of same.

* * * * *